US011448028B2

(12) United States Patent
Al-Mousa et al.

(10) Patent No.: US 11,448,028 B2
(45) Date of Patent: Sep. 20, 2022

(54) MILLING PACKERS BELOW RESTRICTIONS IN A WELLBORE CASING

(71) Applicant: Saudi Arabian Oil Company, Dhahran (SA)

(72) Inventors: Ahmed Al-Mousa, Dhahran (SA); Enrique Avila Faull, Dhahran (SA); Ahmed A. Al-Ramadhan, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 16/987,104

(22) Filed: Aug. 6, 2020

(65) Prior Publication Data

US 2022/0042389 A1 Feb. 10, 2022

(51) Int. Cl.
*E21B 29/10* (2006.01)
*E21B 10/26* (2006.01)
(Continued)

(52) U.S. Cl.
CPC ..... *E21B 29/10* (2013.01); *E21B 10/265* (2020.05); *E21B 10/325* (2013.01);
(Continued)

(58) Field of Classification Search
CPC ..... E21B 29/005; E21B 31/16; E21B 31/20; E21B 29/002; E21B 10/265; E21B 10/325
See application file for complete search history.

(56) References Cited

U.S. PATENT DOCUMENTS 1,392,650 A 10/1921 Mcmillian
1,580,352 A 4/1926 Ercole
(Continued)

FOREIGN PATENT DOCUMENTS

EP 2964874 1/2016
WO WO 2011041562 4/2011
WO WO2018164680 9/2018

OTHER PUBLICATIONS

Al-Ibrahim et al., "Automated Cyclostratigraphic Analysis in Carbonate Mudrocks Using Borehole Images," posted presented at the 2014 AAPG Annual Convention and Exhibition, Search and Discovery Article #41425, Apr. 6-9, 2014, 4 pages.
(Continued)

*Primary Examiner* — Giovanna Wright
*Assistant Examiner* — Jonathan Malikasim
(74) *Attorney, Agent, or Firm* — Fish & Richardson P.C.

(57) ABSTRACT

Tools and methods are described for removing a packer beyond a restriction in a casing of a wellbore. A packer milling tool includes: a milling body with an outer diameter; milling blocks positioned at intervals around a circumference of the milling body, each milling block pivotably attached to the milling body and pivotable between a running position and a milling position; and a wash pipe extending from a downhole end of the milling body. The milling blocks have a rotational circumference with a rotational diameter that is less than the outer diameter of the milling body when in the running position and the rotational diameter is more than the outer diameter of the milling body and less than the inner diameter of the casing when in the milling position.

13 Claims, 8 Drawing Sheets

(51) Int. Cl.

| | |
|---|---|
| ***E21B 10/32*** | (2006.01) |
| ***E21B 29/00*** | (2006.01) |
| ***E21B 31/16*** | (2006.01) |
| ***E21B 31/20*** | (2006.01) |

(52) U.S. Cl.
CPC ..... *E21B 29/005* (2013.01); *E21B 31/16* (2013.01); *E21B 31/20* (2013.01); *E21B 29/002* (2013.01)

(56) References Cited

U.S. PATENT DOCUMENTS

| | | | | |
|---|---|---|---|---|
| 1,621,947 | A | 3/1927 | Moore | |
| 1,638,494 | A | 8/1927 | Lewis et al. | |
| 2,481,637 | A | 9/1949 | Yancey | |
| 2,728,599 | A | 12/1955 | Moore | |
| 2,745,693 | A | 5/1956 | Mcgill | |
| 2,751,010 | A | 6/1956 | Trahan | |
| 2,778,428 | A | 1/1957 | Baker et al. | |
| 2,915,127 | A | 12/1959 | Abendroth | |
| 2,947,362 | A * | 8/1960 | Smith | E21B 31/20 166/178 |
| 3,308,886 | A | 3/1967 | Evans | |
| 3,352,593 | A | 11/1967 | Webb | |
| 3,380,528 | A | 4/1968 | Durwood | |
| 3,382,925 | A | 5/1968 | Jennings | |
| 3,437,136 | A | 4/1969 | Young | |
| 4,254,983 | A | 3/1981 | Harris | |
| 4,296,822 | A | 10/1981 | Ormsby | |
| 4,616,721 | A | 10/1986 | Furse | |
| 4,997,225 | A | 3/1991 | Denis | |
| 5,456,312 | A | 10/1995 | Lynde et al. | |
| 5,605,366 | A | 2/1997 | Beeman | |
| 5,639,135 | A | 6/1997 | Beeman | |
| 5,881,816 | A | 3/1999 | Wright | |
| 6,681,858 | B2 * | 1/2004 | Streater | E21B 31/20 166/301 |
| 7,188,675 | B2 | 3/2007 | Reynolds | |
| 7,367,412 | B2 * | 5/2008 | Barbera | E21B 10/20 175/323 |
| 7,448,446 | B2 * | 11/2008 | Campbell | E21B 23/01 166/117.6 |
| 7,730,974 | B2 * | 6/2010 | Minshull | E21B 10/34 175/292 |
| 8,991,489 | B2 | 3/2015 | Redlinger et al. | |
| 9,163,469 | B2 | 10/2015 | Broussard et al. | |
| 9,453,374 | B2 * | 9/2016 | Sullivan | E21B 37/00 |
| 2002/0053428 | A1 | 5/2002 | Maples | |
| 2007/0256867 | A1 | 11/2007 | DeGeare et al. | |
| 2010/0089583 | A1 | 4/2010 | Xu et al. | |
| 2010/0270018 | A1 | 10/2010 | Howlett | |
| 2011/0005836 | A1 | 1/2011 | Radford et al. | |
| 2012/0118571 | A1 | 5/2012 | Zhou | |
| 2016/0046529 | A1 * | 2/2016 | Bricco | E21B 10/46 175/425 |
| 2019/0292897 | A1 * | 9/2019 | Costa de Oliveira | E21B 17/10 |
| 2020/0032604 | A1 | 1/2020 | Al-Ramadhan | |

OTHER PUBLICATIONS

Bautista et al., "Probability-based Dynamic TimeWarping for Gesture Recognition on RGB-D data," WDIA 2012: Advances in Depth Image Analysis and Application, 126-135, International Workshop on Depth Image Analysis and Applications, 2012, 11 pages.
Boriah et al., "Similarity Measures for Categorical Data: A Comparative Evaluation," presented at the SIAM International Conference on Data Mining, SDM 2008, Apr. 24-26, 2008, 12 pages.
Edwards et al., "Assessing Uncertainty in Stratigraphic Correlation: A Stochastic Method Based on Dynamic Time Warping," RM13, Second EAGE Integrated Reservoir Modelling Conference, Nov. 16-19, 2014, 2 pages.
Edwards, "Construction de modèles stratigraphiques à partir de données éparses," Stratigraphie, Université de Lorraine, 2017, 133 pages, English abstract.
Fischer, "The Lofer Cyclothems of the Alpine Triassic," published in Merriam, Symposium on cyclic sedimentation: Kansas Geological Survey, Bulletin 169: 107-149, 1964, 50 pages.
Hernandez-Vela et al., "Probability-based Dynamic Time Warping and Bag-of-Visual-and-Depth-Words for human Gesture Recognization in RGB-D," Pattern Recognition Letters 50: 112-121, 2014, 10 pages.
Herrera and Bann, "Guided seismic-to-well tying based on dynamic time warping," SEG Las Vegas 2012 Annual Meeting, Nov. 2012, 6 pages.
Keogh and Ratanamahatana, "Exact indexing of dynamic time warping," Knowledge and Information Systems, Springer-Verlag London Ltd., 2004, 29 pages.
Lallier et al., "3D Stochastic Stratigraphic Well Correlation of Carbonate Ramp Systems," IPTC 14046, presented at the International Petroleum Technology Conference, IPTC, Dec. 7-9, 2009, 5 pages.
Lallier et al., "Management of ambiguities in magnetostratigraphic correlation," Earth and Planetary Science Letters, 371-372: 26-36, 2013, 11 pages.
Lallier et al., "Uncertainty assessment in the stratigraphic well correlation of a carbonate ramp: Method and application of the Beausset Basin, SE France," C. R. Geoscience 348: 499-509, 2016, 11 pages.
Lineman et al., "Well to Well Log Correlation Using Knowledge-Based Systems and Dynamic Depth Warping," SPWLA Twenty-Eighth Annual Logging Symposium, Jun. 29-Jul. 2, 1987, 25 pages.
Nakanishi and Nakagawa, "Speaker-Independent Word Recognitation by Less Cost and Stochastic Dynamic Time Warping Method," ISCA Archive, European Conference on Speech Technology, Sep. 1987, 4 pages.
Pels et al., "Automated biostratigraphic correlation of palynological records on the basis of shapes of pollen curves and evaluation of next-best solutions," Palaeogeography, Palaeoclimatology, Palaeoecology 124: 17-37, 1996, 21 pages.
Pollack et al., "Automatic Well Log Correlation," AAPG Annual Convention and Exhibition, Apr. 3, 2017, 1 page, Abstract Only.
Rudman and Lankston, "Stratigraphic Correlation of Well Logs by Computer Techniques," The American Assoociation of Petroleum Geologists, vol. 53, No. 3: 557-588, Mar. 1973, 12 pages.
Sakoe and Chiba, "Dynamic Programming Algorithm Optimization for Spoken Word Recognition," IEEE Transactions on Acoustics, Speech and Signal Processing, vol. ASSP-26, No. 1, Feb. 1978, 7 pages.
Salvador and Chan, "FastDTW: Toward Accurate Dynamic Time Warping in Linear Time and Space," presented at the KDD Workshop on Mining Temporal and Sequential Data, Intelligent Data Analysis 11(5):70-80, Jan. 2004, 11 pages.
Sayhi, "peakdet: Peak detection using MATLAB," Jul. 2012, 4 pages.
Silva and Koegh, "Prefix and Suffix Invariant Dynamic Time Warping," presented at the IEEE 16th International Conference on Data Mining, 2016, 6 pages.
Smith and Waterman, "New Stratigraphic Correlation Techniques," Journal of Geology, vol. 88: 451-457, 1980, 8 pages.
Startzman and Kuo, "A Rule-Based System for Well Log Correlation," SPE Formative Evaluation, Society of Petroleum Engineers, Sep. 1987, 9 pages.
Tomasi et al., "Correlation optimized warping and dynamic time warping as preprocessing methods for chromatographic data," Journal of Chemometrics 18: 231-241, 2004, 11 pages.
Uchida et al., "Non-Markovian Dynamic Time Warping," presented at the 21st International Conference on Pattern Recognition, ICPR, Nov. 11-15, 2012, 4 pages.
Waterman and Raymond, "The Match Game: New Stratigraphic Correlation Algorithms," Mathematical Geology, vol. 19, No. 2, 1987, 19 pages.
Zoraster et al., "Curve Alignment for Well-to-Well Log Correlation," SPE 90471, presented at the SPE Annual Technical Conference and Exhibition, Society of Petroleum Engineers, Sep. 26-29, 2004, 6 pages.

(56) References Cited

OTHER PUBLICATIONS

PCT International Search Report and Written Opinion in International Appln. No. PCT/US2021/044957, dated Nov. 18, 2021, 14 pages.

* cited by examiner

MILLING PACKERS BELOW RESTRICTIONS IN A WELLBORE CASING

TECHNICAL FIELD

The present disclosure generally relates to downhole milling tools and methods, more particularly tools and methods for milling and removing a packer downhole of a restriction in a casing of a wellbore. clp BACKGROUND Drilling, operating, and maintaining wellbores includes placing tubular members within the wellbore. For example, casing can line the wellbore in certain configurations. A production packer can seal the outside of a production tubing and the inside of the casing. In some instances, a casing patch is installed in order to repair casing damage, corrosion, or leaks.

SUMMARY

This specification describes milling tools and methods to remove packer (e.g., a production packer) downhole of a restriction in a casing of a wellbore. For example, a casing patch is installed in a wellbore can reduces in the internal diameter of the casing and may cause challenges during operation.

The tools and methods described in this specification provide an approach in which the tool runs in a closed position beyond a narrow place (e.g., at a casing patch) to reach the top of the packer. The tool includes a milling body, rotating pins, milling blocks, and a fishing spear. Once a weight is applied, the milling blocks/blades expand to the full casing drift and can be used to mill the production packer to its full outer diameter without engaging the casing. Once milling is completed, the milling blocks are returned to their closed position. The tool can then be used to fish and retrieve the milled packer and associated tubing across the restriction in the casing.

The approach can be useful in situations when a narrow spot in the casing limits common field operations. For example, it is sometimes necessary to remove a metal tubular, such as a production packer, from the wellbore. If there is a casing patch uphole of the production packer, it was previously not be feasible to mill and to retrieve the production packer across the internal restriction caused by the installation of the casing patch. In such a situation, the casing patch has to be milled, ground away, or both with a consequent risk of re-opening the casing leak or inducing additional damage on the casing. As a result, the production packer is placed at a shallower depth and above the casing patch restriction. In contrast, the approach described in this specification avoids this issue and enables desired placement of the packer without removal of the casing patch.

This tool can be run downhole on a drill pipe. The packer milling tool is disposed circumferentially about a section of drillpipe and runs in a closed position beyond a casing patch restriction to reach the top of the packer. The packer milling tool includes a milling body, milling blocks, rotating pins, and a wash pipe. The milling blocks are disposed at intervals around a circumference of the milling body and extend radially outward when a force is applied in a downhole direction. They rotate between a running position and a milling position using a spring-loaded system. Once milling is completed, the milling blocks return to a closed position and the packer milling tool will fish and retrieve the milled packer across the casing patch restriction. Each of the milling blocks includes a non-metallic outer surface and a hard metallic body. The packer milling tool can be mechanically actuated. The wash pipe extends from a downhole end of the milling body and includes fishing spear that allows to hold the milled packer.

In some aspects, a packer milling tool for removing a packer beyond a restriction in a casing of a wellbore includes: a milling body with an outer diameter; milling blocks positioned at intervals around a circumference of the milling body, each milling block pivotably attached to the milling body and pivotable between a running position and a milling position; and a wash pipe extending from a downhole end of the milling body. The milling blocks have a rotational circumference with a rotational diameter that is less than the outer diameter of the milling body when in the running position and the rotational diameter is more than the outer diameter of the milling body and less than the inner diameter of the casing when in the milling position.

In some aspects, a packer milling tool for removing a packer beyond a restriction in a casing of a wellbore includes: a milling body with an outer diameter; and milling blocks positioned at intervals around a circumference of the milling body, each milling block pivotably attached to the milling body and pivotable between a running position and a milling position. The milling blocks have a rotational circumference with a rotational diameter that is less than the outer diameter of the milling body when in the running position and the rotational diameter is more than the outer diameter of the milling body and less than the inner diameter of the casing when in the running position.

Embodiments of the packer milling tool can include one or more of the following features.

In some embodiments, the milling blocks include a non-metallic outer surface oriented radially outward when the milling blocks are in the milling position.

In some embodiments, the packer milling tool also includes resilient members biasing the milling blocks toward the running position. In some cases, the resilient members include springs. In some cases, the force applied to the milling body in a downhole direction compresses the springs and moves the milling blocks to the milling position. In some cases, the packer milling tool also includes a pilot mill extending from a downhole end of the milling body. In some cases, the packer milling tool also includes a fishing spear extending from a downhole end of the milling body.

In some embodiments, the packer milling tool also includes a pilot mill attached to the wash pipe.

In some embodiments, the packer milling tool also includes a fishing spear attached to the wash pipe.

In some embodiments, the packer milling tool also includes a plurality of rotating pins. A pair of the plurality of rotating pins are arranged at intervals and on opposite ends on each milling block.

In some aspects, a method for milling a packer in a wellbore includes: identifying a wellbore with a restriction in a casing of the wellbore; lowering a packer milling tool into the wellbore past the restriction with milling blocks of the packer milling tool in running position in which a distance from an axis of the packer milling tool to outer portions of the milling blocks is less than a distance from the axis of the packer milling tool to an outer surface of a body of the packer milling tool; applying a force in the downhole direction to the packer milling tool to open the milling blocks to a milling position in which the distance from the axis of the packer milling tool to outer portions of the milling blocks is more than the distance from the axis of the packer milling tool to the outer surface of the body of the packer milling tool and less than a radius of the casing of the wellbore; and milling the packer in the wellbore.

In some embodiments, the method also includes retrieving the packer across the casing patch restriction after milling the packer. In some cases, retrieving the packer includes engaging the packer with a fishing spear extending from a downhole end of the milling body. In some cases, retrieving the packer includes operating a pilot mill extending from a downhole end of the milling body.

In some embodiments, applying the force in the downhole direction to the packer milling tool to open the milling blocks to the milling position includes applying sufficient force to overcome compress resilient members biasing the milling blocks toward the running position.

In some embodiments, the milling blocks include a non-metallic outer surface oriented radially outward when the milling blocks are in the milling position.

The packer milling tool can help install a production packer deeper within the wellbore and below a casing patch restriction. The production packer can be milled and retrieved across the casing patch restriction without the need to mill the casing patch itself. The packer milling tool provides options to complete the well beyond the presence of the casing restriction. The tool design removes limitations during de-completing the well with milling and retrieving the production packer below the casing patch. This can reduce the wellbore operation time. The non-metallic outer surface of the milling blocks of the tool prevent wear and damage of the casing during milling operations. These factors can result in improved and efficient milling operation and can help prevent the risk of accidental side tracking.

The details of one or more embodiments of these systems and methods are set forth in the accompanying drawings and the description below. Other features, objects, and advantages of these systems and methods will be apparent from the description and drawings, and from the claims.

DETAILED DESCRIPTION

This specification describes packer milling tools and milling methods to remove a production packer beyond a restriction in a casing of a wellbore. This tool can be used as part of a production system in a wellbore. The packer milling tool is disposed circumferentially about a section of drillpipe and runs in a closed position beyond the casing patch restriction to reach the top of the packer. This packer milling tool includes a milling body, milling blocks, rotating pins, and, optionally, a wash pipe. The milling blocks are disposed at intervals around a circumference of the milling body and extend radially outward when a force is applied in a downhole direction. The milling blocks rotate between a running position and a milling position using a spring-loaded system. Once milling is completed, the milling blocks return to a closed position and the packer milling tool will fish and retrieve the milled packer across the casing patch restriction. Each of the milling blocks includes a non-metallic outer surface and a hard metallic body. The packer milling tool can be mechanically actuated. When included, the wash pipe extends from a downhole end of the milling body and includes fishing spear that allows to hold the milled packer.

Figure 1:
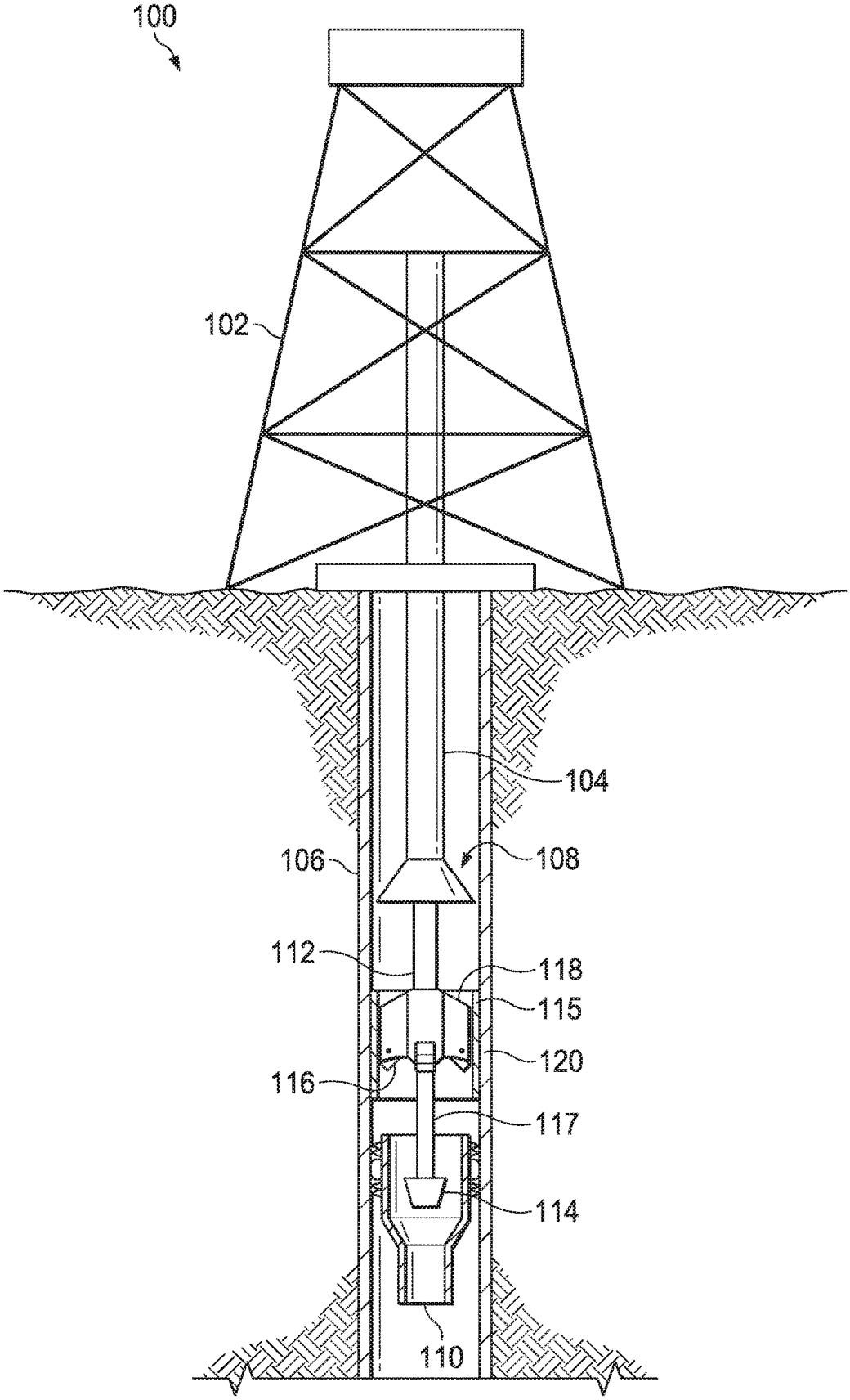
FIG. 1 is a schematic view of a production system including a packer milling tool.

FIG. 1 is a schematic view of a wellsite 100 includes a derrick 102 that supports a production system 104 within a wellbore 106. A packer milling tool 108 configured to mill and retrieve a tubular 110 (e.g., a production packer) beyond a restriction 115 of a casing 120 within the wellbore 106. The packer milling tool 108 is disposed circumferentially about a section of a drillpipe 112 and includes a milling body 118, milling blocks 116, and a wash pipe 117. The milling body 118 has an outer diameter that is less than the inner diameter of the casing 120. The milling body may have a clearance of 0.5 inches so that it can pass smoothly through the casing patch restriction. In an example, a casing patch placed inside a 7 inches casing with 6.3 inches inner diameter will reduce the accessible inner diameter to 6 inches. In another example, for large casing (e.g., 9-⅝ inches in size) the clearance can be increased to 1 inch or more as the milling body is larger with larger milling blocks to pass inside the casing. The milling blocks 116 are pivotably attached to the milling body 118. The wash pipe 117 extends from a downhole end of the milling body 118 and has a fishing spear 114 attached to it.

During operations, a location of the restriction 115 of the casing 120 is identified. The packer milling tool 108 is lowered, in a closed position, past the restriction 115, and onto the target tubular 110 and rotated. A force applied to the milling body 118 in a downhole direction expands the milling blocks 116 to the full drift diameter of the casing 120 such that the packer milling tool mills the target tubular 110 to its full outer diameter. The packer milling tool 108 mills the target tubular 110 into smaller pieces without leaving the external body of the milled tubular 110. The force on the packer milling tool 108 can be adjusted during operations and is controlled by an operator at the surface. The force on the packer milling tool 108 also has an impact on the milling rate. Usually the users control the force on the packer milling tool 108 and the rotational speed in rotations per minute (RPM) to achieve best milling rate. Desired parameters can vary between well sites and individual circumstances. In an example, the applied force on the packer milling tool is between 20,000 and 40,000 pounds (lbs). The rotational speed is typically between 50 and 100 RPM. Once the milling is completed, the milling blocks 116 go back to a closed position. The milled tubular 110 is fished and retrieved by the fishing spear 114 across the restriction 115 area of the casing 120. While the illustrated system 100 is shown in the context of a vertical wellbore, the packer milling tool 108 can also be used in deviated or horizontal wellbores.

Figure 2B:
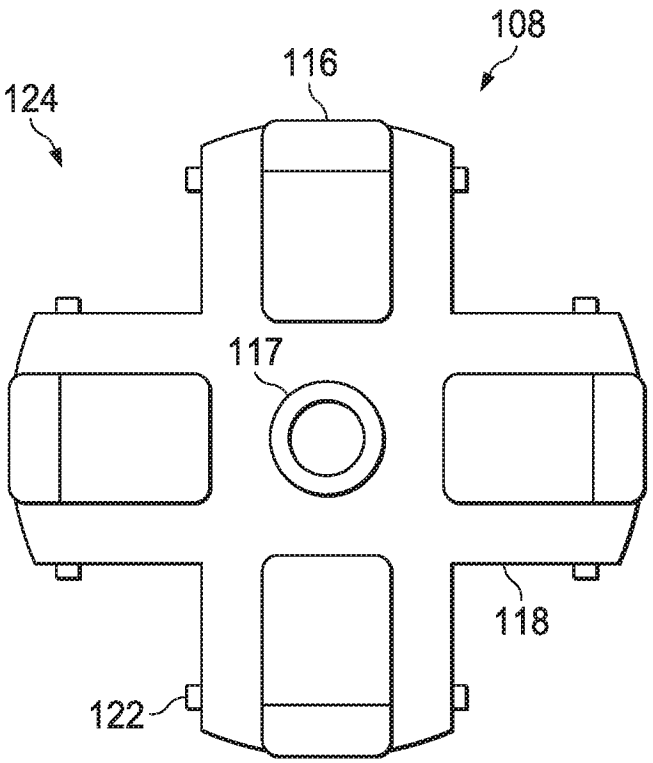
FIGS. 2A-2C are schematic views of a packer milling tool, in its closed position.
Figure 2A:
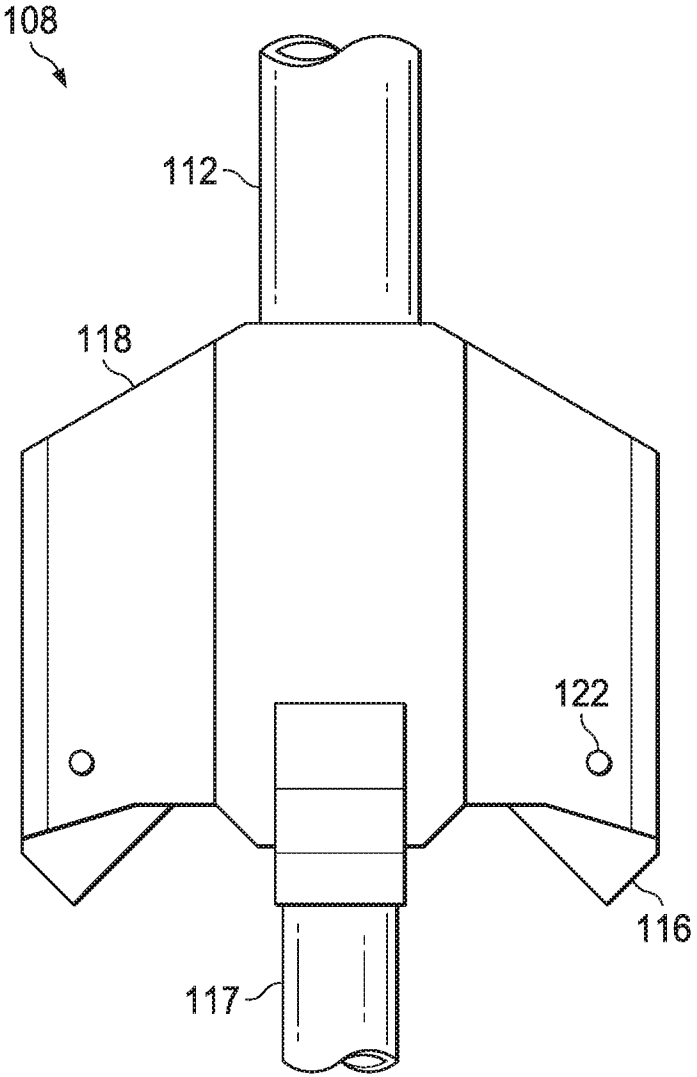
Figure 2C:
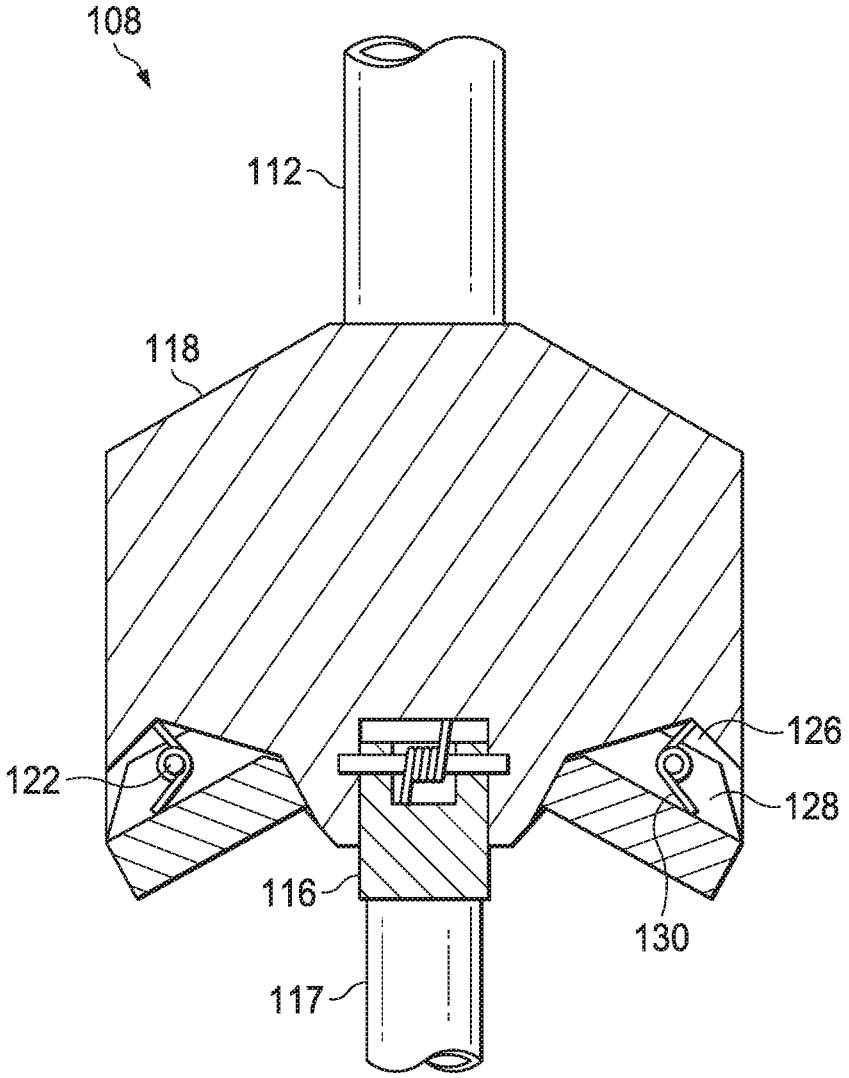

FIGS. 2A-2C are schematic views of a packer milling tool 108 in its closed position 124. As illustrated, the milling blocks 116 are positioned at intervals around a circumference of the milling body 118. Each milling block is pivotably attached to the milling body 118 and pivotable between a running position 124 (e.g., closed position) and a milling position 142 (e.g., open position, shown in FIGS. 3A-3C). The milling body 118 includes a groove 126 in which each of the milling blocks 116 rotates around a pin 122. An additional groove 128 is formed along an upper portion of each of the milling blocks 116. The groove 128 is seated inside the groove 126 of the milling body 118. When in the running position 124, the milling blocks 116 have a rotational circumference with a rotational diameter that is less than the outer diameter of the milling body 118. Inside each groove 128, a resilient member 130 is loaded around the pin 122 that biases the milling blocks 116 towards the running position 124 when a load is removed. The resilient member 130 can include springs. The outer surface of each of the milling blocks 116 includes a non-metallic material (e.g., Teflon). This reduces wear of the milling blocks 116. The inner body of each of the milling blocks 116 includes a hard-grade metallic material (e.g., carbon steel body with tungsten carbide face of the milling block). The milling body 118 can include three, four, or more milling blocks 116. In an example, for 7 inch casing with 6-inch drift inner diameter and 2.875 inches outer diameter of a wash pipe, the size of the face of each of the milling blocks is 1.5 inches× 1.5 inches. The milling body 118 can also include a plurality of rotating pins 122 arranged at intervals on opposite ends of each of the milling blocks 116. The rotating pins 122 provide partial support to each milling block and enable the milling blocks 116 to pivot between a running position 124 and a milling position 142 (e.g., by providing axis of rotation).

Figure 3B:
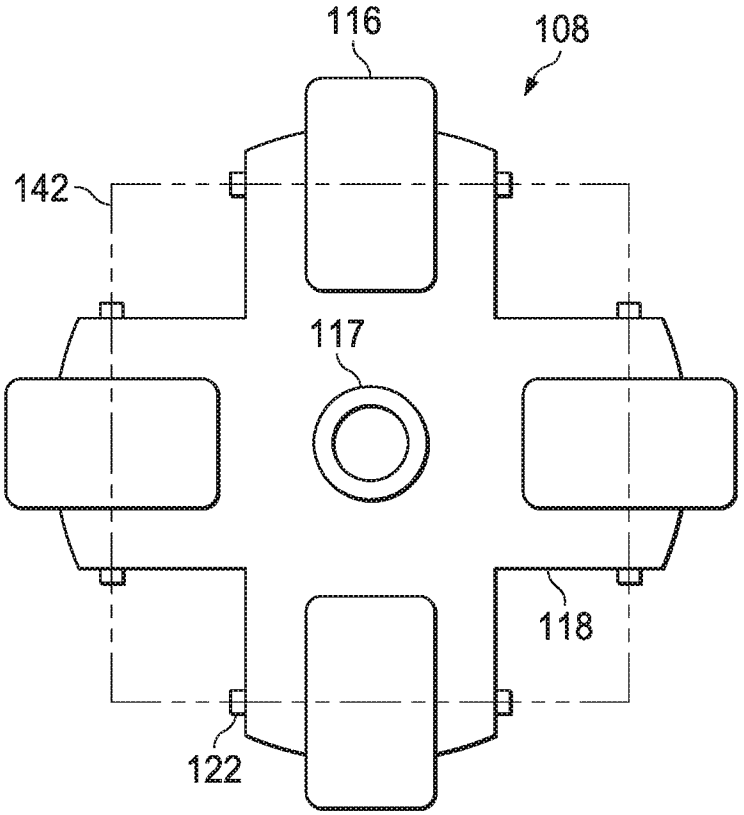
FIGS. 3A-3C are schematic views of a packer milling tool, in its open position.
Figure 3A:
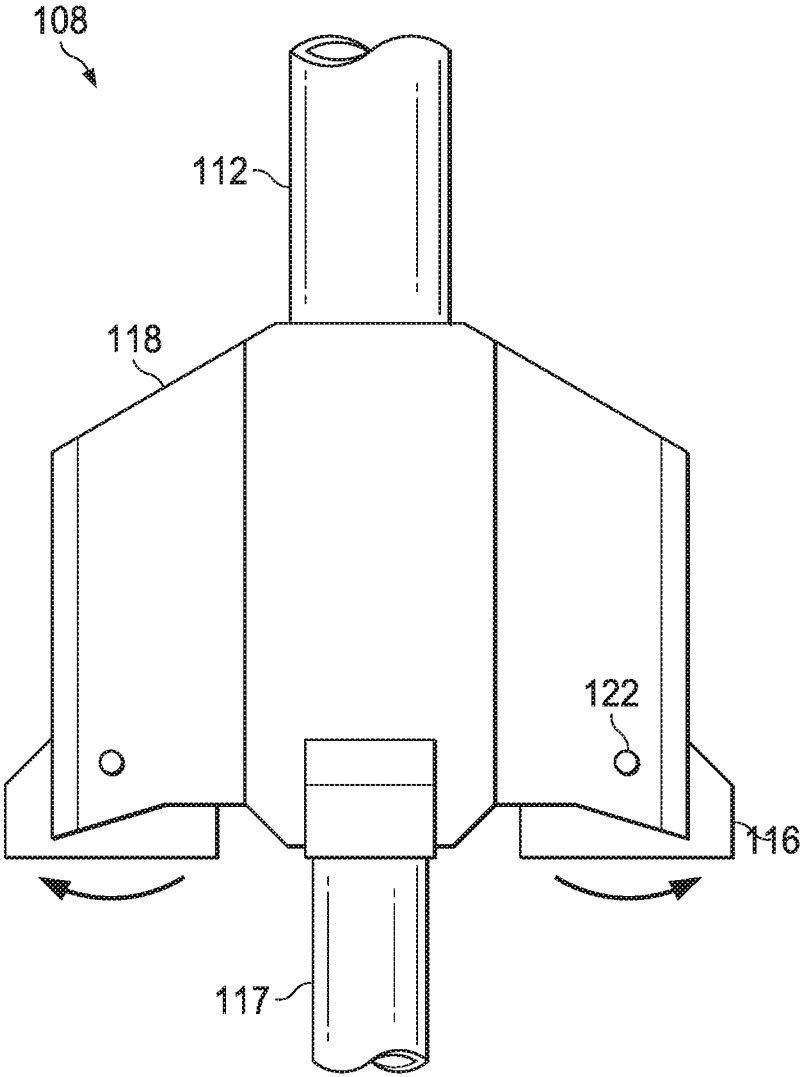
Figure 3C:
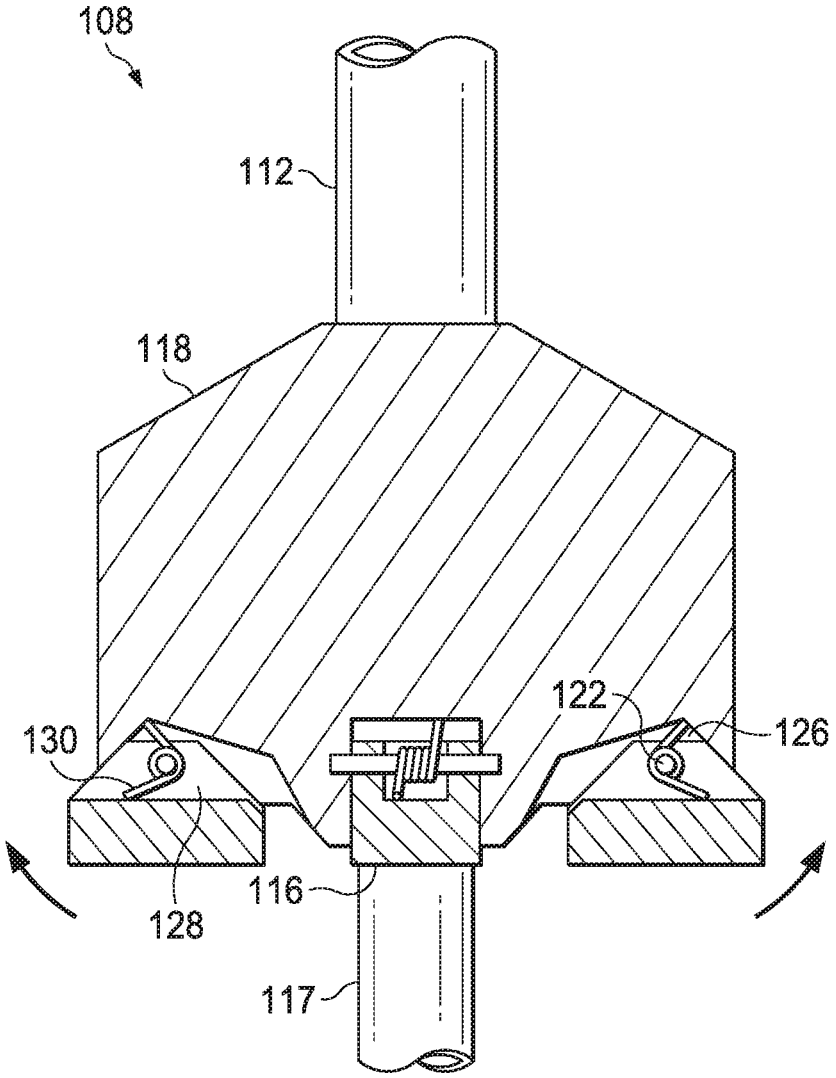

FIGS. 3A-3C are schematic views of a packer milling tool 108, in its open position 142. A force is applied to the milling body 118 in a downhole direction rotates the milling blocks 116 outward against the bias of the springs. The milling blocks 116 rotate against the spring force and expand outwards towards the internal shoulders of the groove 126. This supports the loads on the milling blocks 116 and enables them to expand up to the drift diameter of the casing 120. In the milling position 142, the non-metallic outer surface of the milling blocks 116 is oriented radially outward. The rotational diameter of the milling blocks 116 in the milling position is more than the outer diameter of the milling body 118 and less than the inner diameter of the casing 120.

Figure 4A:
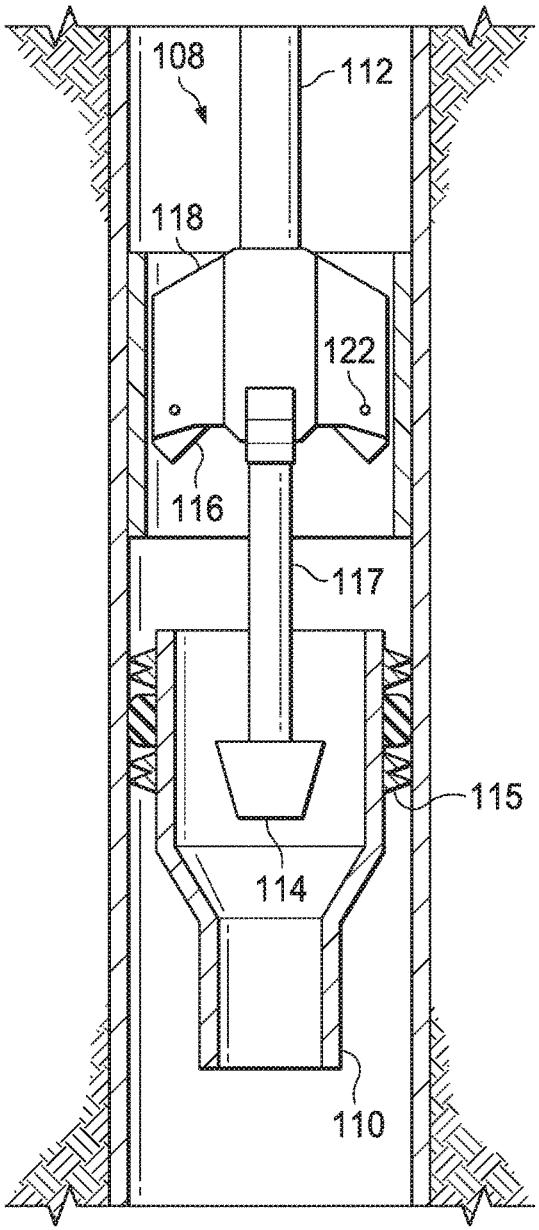
FIGS. 4A-4D are schematic views of a packer milling tool in various stages of operation.
Figure 4B:
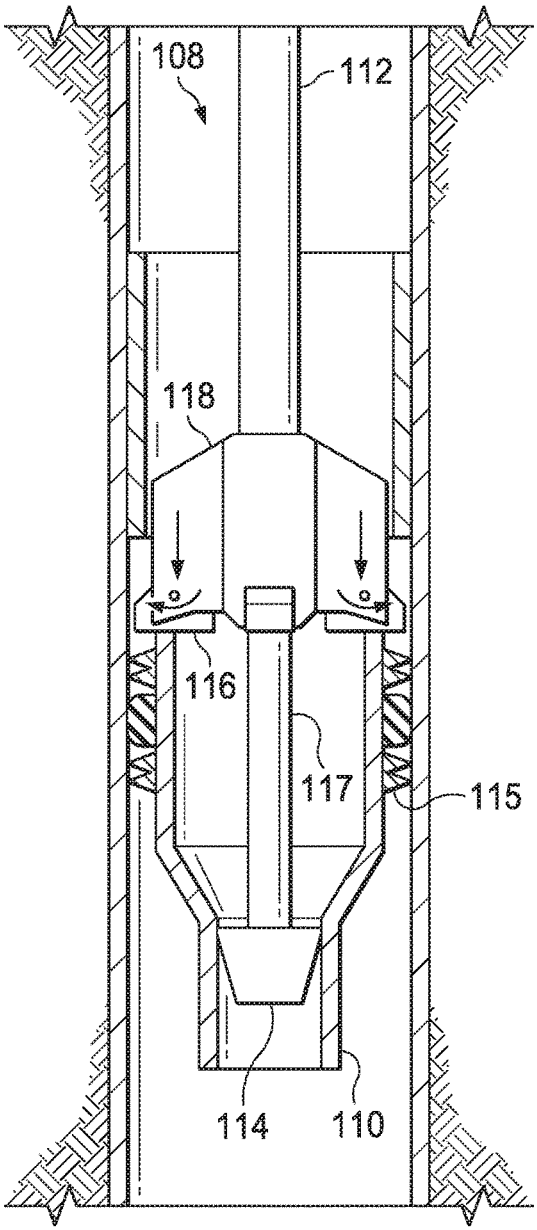
Figure 4C:
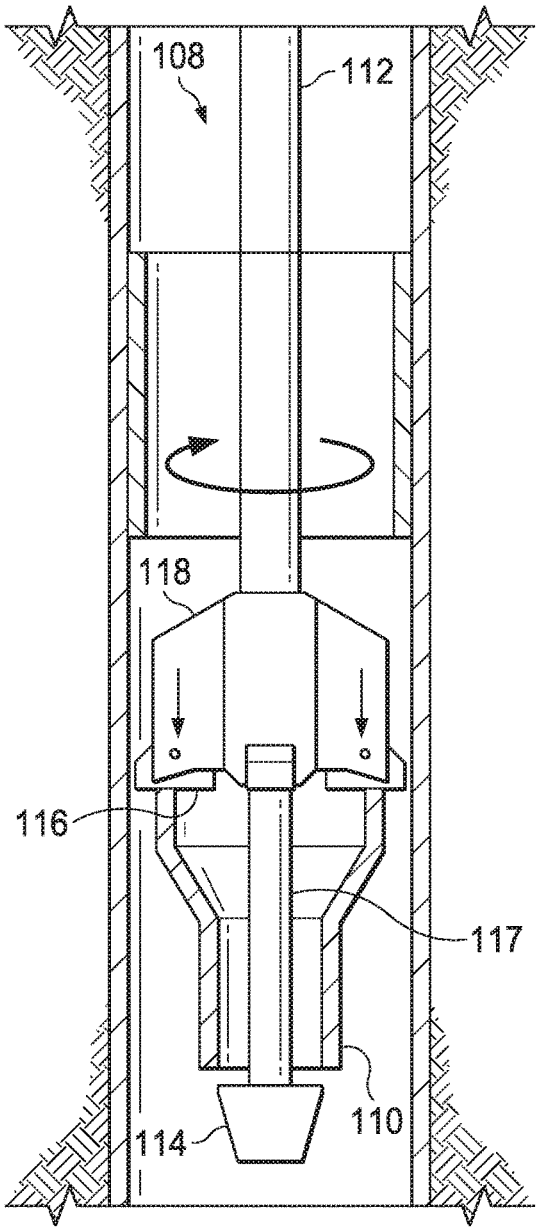
Figure 4D:
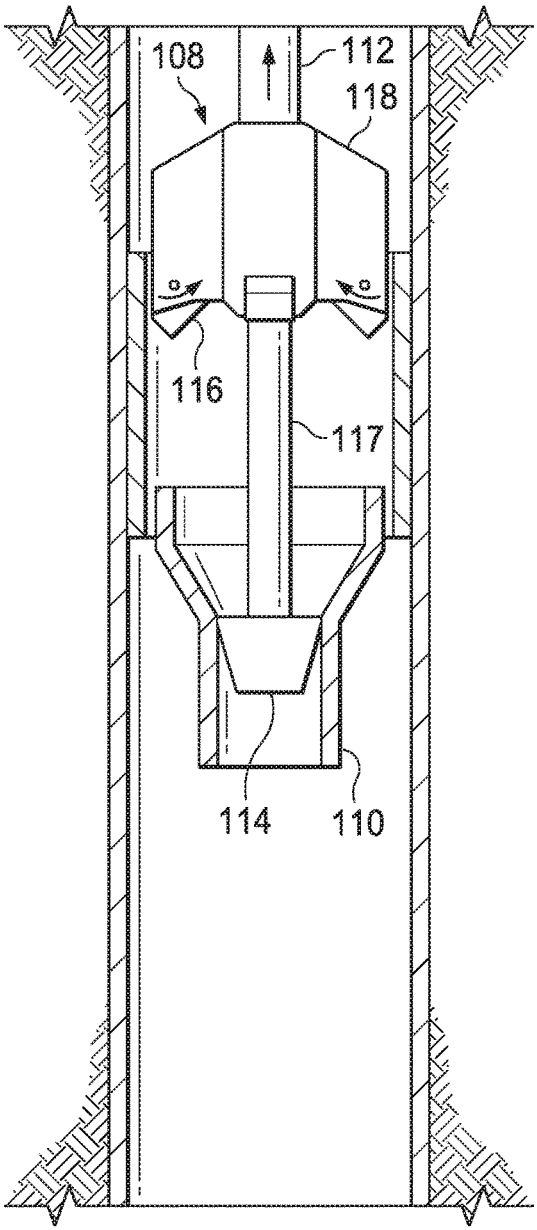

FIGS. 4A-4D are schematic views of the packer milling tool 108 in various stages of operation. In FIG. 4A, the packer milling tool 108 is centered downhole through the casing 120 in a closed position 124. In FIG. 4B, the packer milling tool 108 has been moved past the restriction 115 in the casing 120 into contact with the production packer. The resulting a force applied to the milling body 118 expands the milling blocks 116 outward to their milling position 142. In FIG. 4C, the drill string and packer milling tool 108 rotate clockwise and the milling blocks 116 mill the tubular 110. Once the milling of the tubular 110 is complete, the drill pipe is pulled uphole releasing the force so the packer milling tool 108 returns back to its running position 124. The wash pipe 117 helps retain the milled tubular 110 on the packer milling tool 108. The packer milling tool 108 carries the milled tubular 110 across the restriction 115 and removes it from the wellbore 106 (as shown in FIG. 4D).

Figure 5:
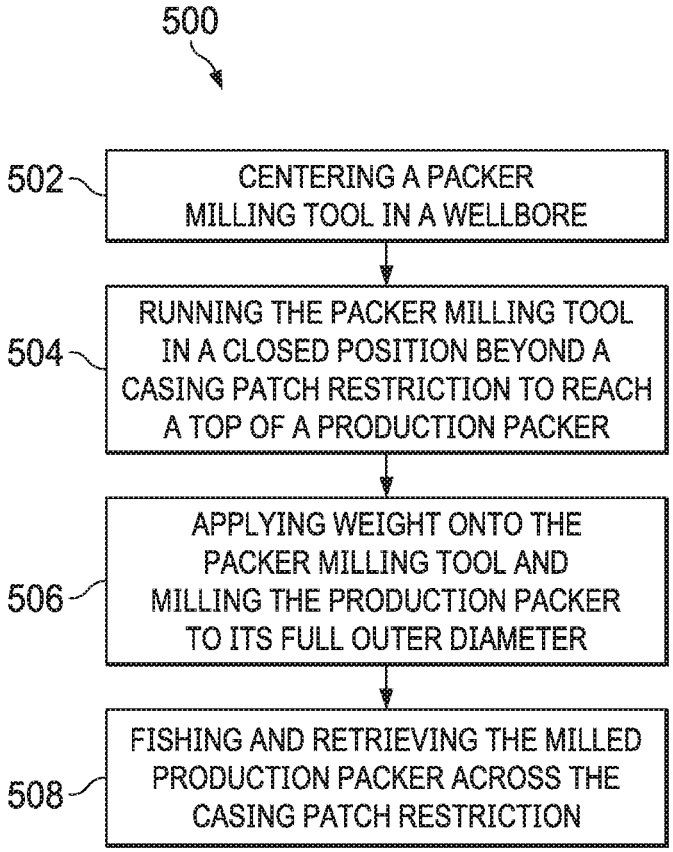
FIG. 5 is a flowchart showing a method for milling and removing a packer from a wellbore.

FIG. 5 is a flowchart showing a method 500 for milling and removing a packer from a wellbore. After the restriction location of the casing is identified in the wellbore (502), a packer milling tool is lowered and centered into the wellbore in a running position. In this running position, the distance from an axis of the packer milling tool to outer portions of the milling blocks is less than the distance from the axis of the packer milling tool to an outer surface of a body of the packer milling tool. The packer milling tool, in its running position, is lowered beyond the casing patch restriction to reach a top of a production packer (504). A force is applied in a downhole direction to the packer milling tool to open the milling blocks to their milling position (506). In a milling position, the distance from the axis of the packer milling tool to outer portions of the milling blocks is more than the distance from the axis of the packer milling tool to the outer surface of the body of the packer milling tool and less than the radius of the casing of the wellbore. In its milling position, the packer milling tool mills the packer to its full outer diameter. The packer milling tool fishes and retrieves the milled production packer using, for example, a wash pipe or fish spear (508). The wash pipe or fish spear extends from a downhole end of a wash pipe and carries the milled packer across the casing patch restriction area and outside the wellbore.

The packer milling tool can be assembled or operated in a variety of ways without departing from this disclosure. For example, the packer milling tool can be hydraulically actuated using a ball seat. The ball seat can divert the flow inside the milling body to internal pistons and can expand the milling blocks outwards.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Accordingly, the previously described example implementations do not define or constrain the present disclosure. Other changes, substitutions, and alterations are also possible without departing from the spirit and scope of the present disclosure.

A number of embodiments of these systems and methods have been described. Nevertheless, it will be understood that various modifications may be made without departing from the spirit and scope of this disclosure. Accordingly, other embodiments are within the scope of the following claims.

What is claimed is:

1. A packer milling tool for removing a packer beyond a restriction in a casing of a wellbore, the packer milling tool comprising:

a milling body with an outer diameter;

milling blocks positioned at intervals around a circumference of the milling body, each milling block pivotably attached to the milling body and pivotable between a running position and a milling position; and a wash pipe extending from a downhole end of the milling body;

a fishing spear attached to the wash pipe;

wherein the milling blocks have a rotational circumference with a rotational diameter that is less than the outer diameter of the milling body when in the running position and the rotational diameter is more than the outer diameter of the milling body and less than an inner diameter of the casing when in the milling position; and wherein the milling blocks comprise a non-metallic outer surface oriented radially outward when the milling blocks are in the milling position.

2. The packer milling tool of claim 1, further comprising resilient members biasing the milling blocks toward the running position.

3. The packer milling tool of claim 2, wherein the resilient members comprise springs.

4. The packer milling tool of claim 3, wherein force applied to the milling body in a downhole direction compresses the springs and moves the milling blocks to the milling position.

5. The packer milling tool of claim 1, further comprising a plurality of rotating pins, wherein a pair of the plurality of rotating pins are arranged at intervals and on opposite ends on each milling block.

6. A packer milling tool for removing a packer beyond a restriction in a casing of a wellbore, the packer milling tool comprising:

a milling body with an outer diameter;

a fishing spear extending from a downhole end of the milling body;

milling blocks positioned at intervals around a circumference of the milling body, each milling block pivotably attached to the milling body and pivotable between a running position and a milling position; and resilient members biasing the milling blocks toward the running position;

wherein the milling blocks have a rotational circumference with a rotational diameter that is less than the outer diameter of the milling body when in the running position and the rotational diameter is more than the outer diameter of the milling body and less than an inner diameter of the casing when in the milling position.

7. The packer milling tool of claim 6, wherein the resilient members comprise springs.

8. The packer milling tool of claim 7, wherein force applied to the milling body in a downhole direction compresses the springs and moves the milling blocks to the milling position.

9. The packer milling tool of claim 6, wherein the milling blocks comprise a non-metallic outer surface oriented radially outward when the milling blocks are in the milling position.

10. The packer milling tool of claim 6, further comprising a wash pipe extending from the downhole end of the milling body.

11. A method for milling a packer in a wellbore, the method comprising:

identifying the wellbore with a restriction in a casing of the wellbore;

lowering a packer milling tool into the wellbore past the restriction with milling blocks of the packer milling tool in a running position in which a distance from an axis of the packer milling tool to outer portions of the milling blocks is less than a distance from the axis of the packer milling tool to an outer surface of a body of the packer milling tool;

applying a force in a downhole direction to the packer milling tool to open the milling blocks to a milling position in which the distance from the axis of the packer milling tool to outer portions of the milling blocks is more than the distance from the axis of the packer milling tool to the outer surface of the body of the packer milling tool and less than a radius of the casing of the wellbore;

milling the packer in the wellbore;

wherein applying the force in the downhole direction to the packer milling tool to open the milling blocks to the milling position comprises applying sufficient force to overcome and compress resilient members biasing the milling blocks toward the running position; and retrieving the packer across the restriction after milling the packer.

12. The method of claim 11, wherein retrieving the packer comprises engaging the packer with a fishing spear extending from a downhole end of the milling body.

13. The method of claim 11, wherein the milling blocks comprise a non-metallic outer surface oriented radially outward when the milling blocks are in the milling position.

* * * * *